United States Patent [19]

Ellison et al.

[11] Patent Number: 4,873,779

[45] Date of Patent: Oct. 17, 1989

[54] SCOPE MOUNT BASE FOR A BLACK POWDER RIFLE

[75] Inventors: Larry J. Ellison, Sevierville; John R. Smelcer, Dandridge, both of Tenn.

[73] Assignee: Leonard G. Adams, Alcoa, Tenn. ; a part interest

[21] Appl. No.: 311,603

[22] Filed: Feb. 16, 1989

[51] Int. Cl.[4] ..... F41G 1/38

[52] U.S. Cl. ..... 42/101; 33/245

[58] Field of Search ..... 42/101; 33/245–250

[56] References Cited

U.S. PATENT DOCUMENTS

| | | | |
|---|---|---|---|
| 2,345,249 | 3/1944 | Ferriroli | 33/245 |
| 2,365,976 | 12/1944 | Sorensen | 33/250 |
| 2,464,134 | 3/1949 | Hugg | 33/245 |
| 3,513,549 | 5/1970 | Smiley | 33/250 |
| 4,509,282 | 4/1985 | McMillon | 33/245 |

OTHER PUBLICATIONS

Arms and Equipment of the Civil War, Jack Coggins, 1969 "Typical Sniper Rifle", p. 37.

*Primary Examiner*—Deborah L. Kyle
*Assistant Examiner*—Michael J. Carone
*Attorney, Agent, or Firm*—Luedeka, Hodges & Neely

[57] ABSTRACT

A scope mount base enables a scope to be mounted upon a black powder rifle with no need that additional mounting holes be drilled and tapped in the rifle barrel. The base includes a bar adapted to be secured to factory-formed holes in the rifle barrel and is particularly well-suited for use in conjunction with scope mounting rings which provide the user with the option of sighting the rifle through the iron sights of the rifle or the scope.

13 Claims, 4 Drawing Sheets

SCOPE MOUNT BASE FOR A BLACK POWDER RIFLE

BACKGROUND OF THE INVENTION

This invention relates generally to firearms and relates more particularly to means by which a telescopic sight, or scope, is mounted upon a black powder rifle.

Commonly, mounting hardware necessary for mounting a scope upon a rifle requires that holes be drilled and tapped in the rifle barrel by the purchaser. The mounting hardware is then fixed to the barrel by means of the tapped holes, and the scope is then affixed to the hardware to thereby secure the scope to the barrel.

While the drilling and tapping of holes for the purpose of mounting a scope may be permissible in selected types of rifles, it is not normally desirable in the case of black powder rifles. When fired, black powder rifles generate very high pressures within the rear of the barrel, and the drilling and tapping of holes in the barrel may weaken the barrel and substantially increase the chances of barrel blow-up. In this connection, it is not uncommon that a manufacturer of black powder rifles considers the factory warranty voided if a purchaser drills holes in the barrel of a rifle constructed by the manufacturer.

It is an object of the present invention to provide a new and improved mount base for mounting a scope upon a black powder rifle which does not require that a purchaser drill holes in the barrel of his rifle.

Another object of the present invention is to provide such a mount base which is attachable to the rifle with tapped holes that are factory-formed within the rifle.

Still another object of the present invention is to provide such a mount base which is adaptable to black powder rifles having a pair of factory-formed holes which are spaced apart by any distance within a range of spacing distances.

A further object of the present invention is to provide such a mount base which enables a user to sight the rifle either through a scope mounted upon the base or with the iron sights of the rifle.

A still further object of the present invention is to provide such a mount base which is uncomplicated in construction and easy to install.

SUMMARY OF THE INVENTION

This invention resides in a scope mount base for a black powder rifle having a pair of factory-formed, pre-tapped openings along its length. One of the pre-tapped openings in the rifle is adapted to receive a screw for holding a rear sight against the rifle barrel, and the other of the pre-tapped openings is adapted to receive a screw for joining the rifle breech to the rifle stock.

The scope mount base is comprised of bar means including a forward portion for attachment to the rifle barrel by means of a screw threadably received by one of the pre-tapped openings in the rifle and a rearward portion for attachment to the breech by means of a screw threadably received by the other of the pre-tapped openings in the rifle. The forward and rearward portions are joined to one another and provide means by which a scope can be secured to the bar means for mounting the scope upon the rifle.

DETAILED DESCRIPTION OF THE ILLUSTRATED EMBODIMENTS

Figure 1:
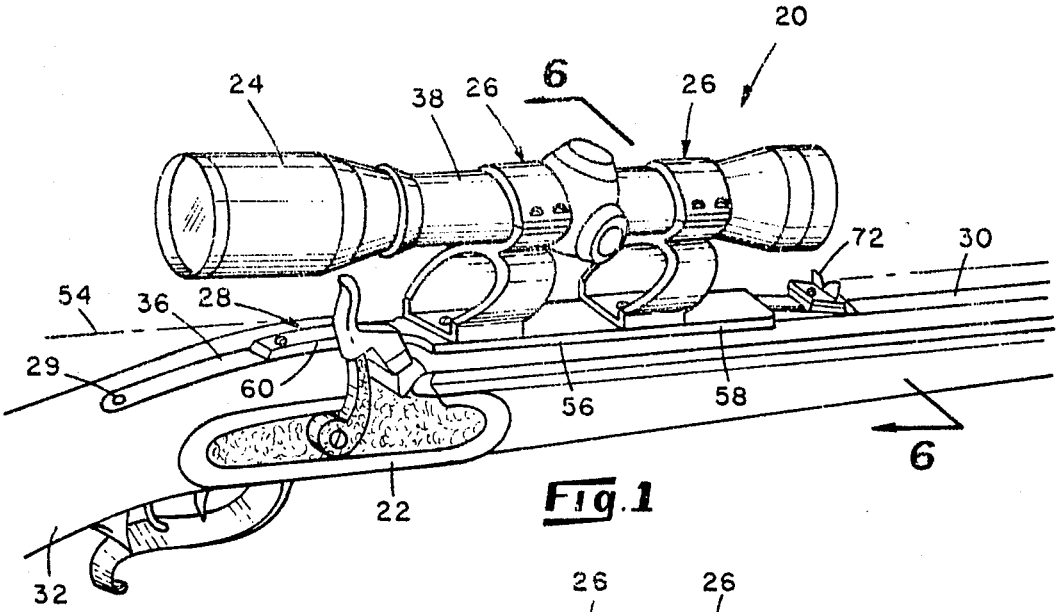
FIG. 1 is a perspective view of an assembly within which an embodiment of a scope mount base is utilized for mounting a scope upon a black powder rifle.
Figure 2:
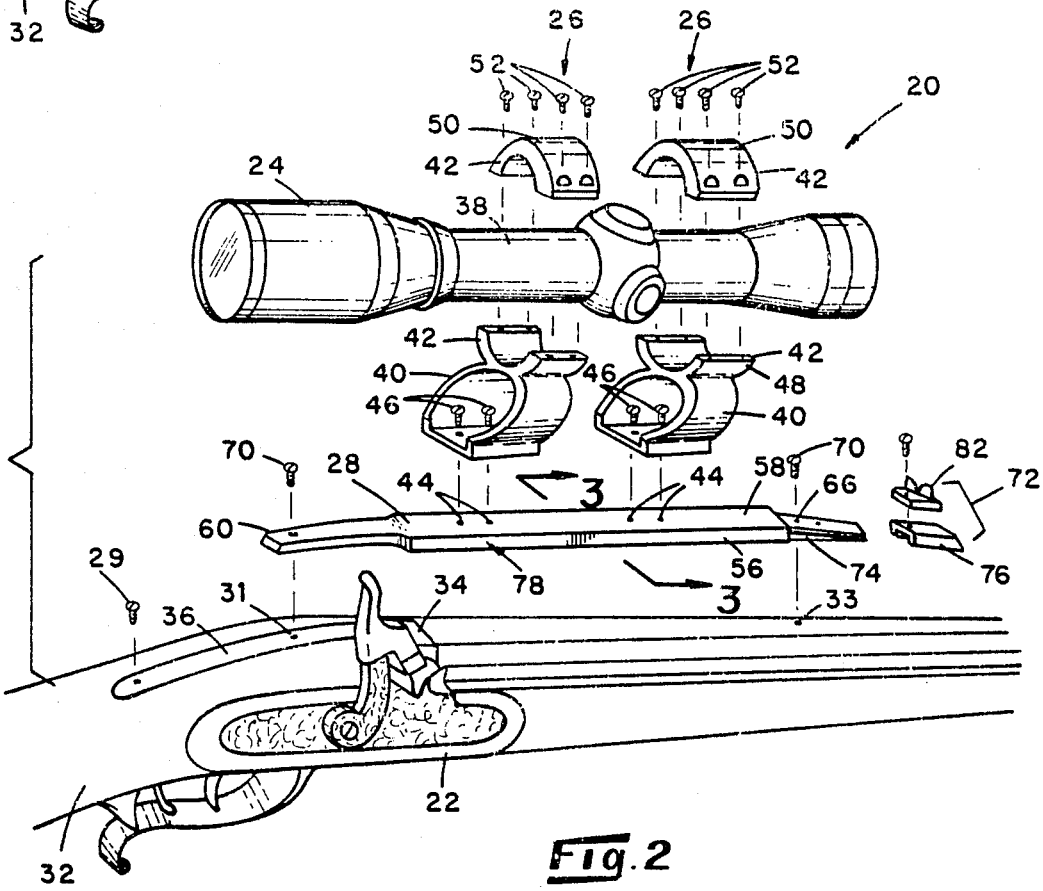
FIG. 2 is a view similar to that of FIG. 1 wherein the components illustrated therein are shown exploded.

Turning now to the drawings in greater detail, there is illustrated in FIGS. 1 and 2 a rifle assembly 20 including a black powder rifle 22, a telescopic sight or scope 24, scope-mounting means in the form of a pair of mounting rings 26 and a scope mount base 28. The scope 24 is secured within the mounting rings 26, and the mounting rings 26 are secured to the scope mount base 28. The mount base 28 is, in turn, attached to the rifle 22 to stably secure the scope 24 and mounting rings 26 to the rifle 22. As will be apparent herein, the scope mount base 28 permits the mounting rings 26 and scope 24 to be operatively fixed upon the rifle 22 in a manner which circumvents any need that a purchaser of the rifle 22 drill and tap holes in the barrel of the rifle 22 for mounting the scope thereupon.

As best shown in FIGS. 1 and 2, the rifle 22 includes an octagon-shaped barrel 30 and a stock 32 to which the barrel 30 is attached. Fixed to the rear of the barrel 30 is a breech plug 34 having a hook which cooperates with a tang 36 fixed within the stock 32 for interconnecting the barrel 30 to the stock 32. The tang 36 is fixed within the stock 32 by means of a first screw 24 and an internally-threaded opening 31 formed in the stock 32 by the rifle manufacturer for receiving a second screw (not shown). For present purposes, the rear of the barrel 30, the breech plug 34 and the tang 36 will be referred to herein as the breech. For sighting the rifle 22, a front iron sight (not shown) is operatively mounted upon the rifle barrel 30 adjacent the forward end thereof. In addition, the rifle barrel 30 defines an internally-threaded opening 33 formed by the rifle manufacturer for the purpose of securing a rear iron sight upon the barrel 30. The manufacturer-provided rear sight, however, has been removed from the rifle 22 so that the base 28 can be attached to the rifle 22 in a manner described herein. The rifle 22 depicted in FIGS. 1 and 2 is commercially available under the trade designation Hawken from Thompson/Center, Rochester, N.H., but it will be understood that the scope mount base 28, rings 26 and scope 24 described herein can be mounted upon other styles and/or brands of black powder rifles.

Figure 3:
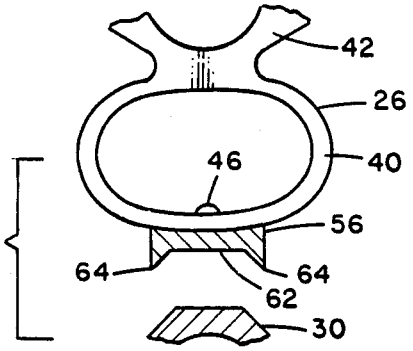
FIG. 3 is a cross-sectional view taken on line 3—3 of FIG. 2.
Figure 4:
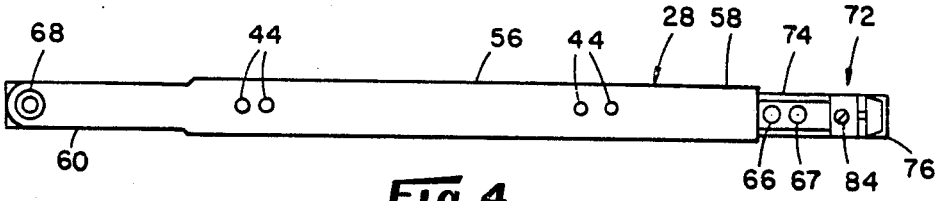
FIG. 4 is a top plan view of the FIG. 1 mount base.

The scope 24 depicted in FIGS. 1 and 2 is conventional in construction and includes a cylindrical body 38 adapted to be secured within the mounting rings 26 in a manner described herein. As best shown in FIGS. 1–3, each mounting ring 26 includes a ring-like support portion 40 adapted to be attached to the mount base 28 and a scope securement portion 42 for securement about the scope body 38. For attachment of the mounting rings 26 to the base 28, each ring-like portion 40 includes a pair of apertures which can be aligned with corresponding internally-threaded holes 44 provided in the mount base 28, and screws 46 are provided for tightening within the base holes 44 so that each ring-like portion 40 can be tightly held between the top surface of the mount base 28 and the head of the screws 46. The scope securement portion 42 includes a first arcuate portion 48 which has been integrally formed with the ring-like portion 40 and a second arcuate portion 50. Collectively, the first and second arcuate portions 48, 50 encircle the scope body 38 and are secured to one another with screws 52 to firmly hold the scope 38 in a stationary relationship within the mounting rings 26.

A feature of the depicted scope mounting rings 26 relates to the openings provided in the ring-like portions 40. More specifically, the openings in the ring-like portions 40 enable the rifle 22 to be sighted through its iron sights. In this connection and as illustrated in FIG. 1, the openings in the ring-like portions 40 encircle the line of sight, indicated 54, along which the rifle 22 is sighted through its iron sights. Therefore, with the scope mounting rings 26 and the scope 24 mounted upon the base 28 and rifle 22, the rifle user is provided with the option of sighting the rifle 22 through either the iron sights or the scope 24 with no need that the scope 24 be removed from the rifle 22 or tilted to an out-of-the-way condition so that the line of sight 54 through the iron sights is unobstructed. The aforedescribed scope mounting rings 26 are commercially available under the trade designation Holden Ironsighter from J. B. Holden Co., Plymouth, Mich.

Figure 5:
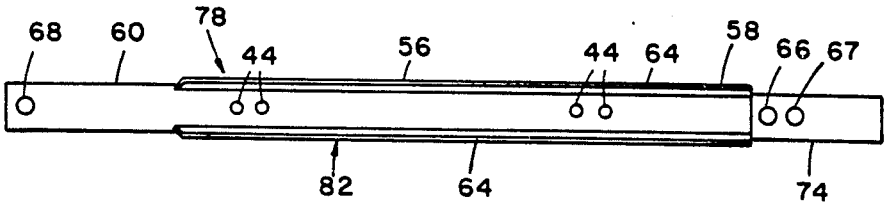
FIG. 5 is a bottom plan view of the FIG. 1 mount base.

With reference again to FIGS. 1, 2, 4 and 5, the scope mount base 28 includes bar means in the form of an elongated bar 56 having a forward portion 58 and a rearward portion 60. The bar 56 is adapted to stably overlie the top of the rifle barrel 30 when positioned thereupon and, to this end, includes an underside shaped generally complementary to the shape of top of the barrel 30. More specifically and as best shown in FIGS. 3 and 5, the underside of the bar 56 includes a flat section 62 bounded by downwardly depending flanges 64 which extend for a major portion of the bar length. When positioned atop the barrel 30, the flat section 62 and flanges 64 accommodate the hexagonal shape of the barrel 30.

The scope mount base 28 is attachable to the rifle barrel 30 in a manner which does not require that the purchaser of the rifle drill and tap holes in the barrel 30 for attachment of the base 28 thereto. Instead, the bar 56 of the base 28 is attachable to the rifle 22 by means of the aforedescribed factory-formed, pre-tapped openings 33, 31 provided in the rifle 22 and used, respectively, for attachment of a rear iron sight to the barrel 30 and for attachment of the breech of the barrel 30 to the stock 32. In this connection, each of the forward portion 58 and rearward portion 60 includes a through-aperture 66 or 68, respectively, so that when the base 28 is operatively positioned upon the rifle 22, the through-aperture 66 is aligned with the pre-tapped rifle opening 33 and the through-aperture 68 is aligned with the pre-tapped rifle opening 31. In the depicted base embodiment 28, each of the bar apertures 66 or 68 is located adjacent a corresponding end of the bar 56. A third aperture 67 is provided adjacent the aperture 66 to permit the base 28 to be attached to a rifle whose openings 31, 33 are spaced at a distance corresponding to the distance between bar apertures 68 and 67.

Screws 70 are tightenable within the rifle openings 33, 31 so that the bar 56 is tightly held between the heads of the screws 70 and the top surface of the rifle 22. It will be understood that in order to expose the pre-tapped openings 31, 33 in the rifle 22 so that the bar 56 can be mounted upon the rifle 22, the screws which secure the manufacturer-provided rear sight (not shown) to the barrel 30 and the front portion of the tang 36 to the stock 32 are removed. The manufacturer-provided rear sight is also removed from the barrel 30 so that the bar 56 may be operatively placed upon the barrel 30.

Figure 6:
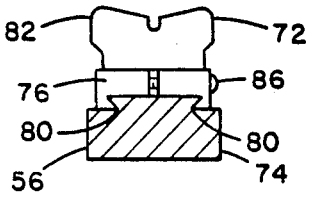
FIG. 6 is a cross-sectional view taken on line 6—6 of FIG. 1 and drawn to a slightly larger scale.

The scope mount 28 base also includes a sight 72 associated with the forward portion 58 of the bar 56. Because the manufacturer-provided rear sight is removed from the rifle 22 before the base 28 is mounted thereto, the sight 72 provides a substitute rear sight for the rifle 22. As best shown in FIG. 2, the forward portion 58 of the bar 56 terminates in a downwardly-sloped end section 74 and the sight 72 includes a support member 76 connected to the end section 74 so that the support member 76 can be slidably moved relative thereto to accommodate an adjustment in elevation of the sight 72. In this connection and as best shown in FIG. 6, the sloping end section 74 is provided with a cross section forming a pair of parallel guide tracks within which V-shaped edges 80 of the support member 76 are captured so that the support member 76 is permitted to slide along the guide tracks.

With reference again to FIGS. 2, 4 and 6, the sight 72 also includes a V-member 82 providing the V of the sight 72 and which is secured atop the support member 76 by means of an adjustment screw 84. The V-member 82 includes a transversely-extending slot, and the screw 84 is threadably received by an aligned opening defined in the support member 76 so that the V-member 82 is held between the support member 76 and the head of the screw 84. By loosening the screw 84, the member 82 can be shifted laterally relative to the support member 76 to alter the lateral position of the V of the sight 72 relative to the rifle barrel 30 and thereby accommodate a windage adjustment of the sight 72. Another screw 86 (FIG. 6) extends laterally through the support member 76 in a known manner to releasably secure the sight 72 in position along the sloped end section 74. When tightened, the screw 86 secures the support member 76 in a stationary position relative to the end section 78, and by loosening the screw 86, the support member 76 can be slidably moved along the aforedescribed guide tracks to adjust the distance between the V-member 82 and the barrel 30 and thereby accommodate an elevation adjustment of the sight 72. It follows that upon mounting the scope mount base 28 upon the rifle 22, the screws 84 and 86 provide means by which the line of sight 54 (FIG. 1) through the iron sights of the rifle 22 can be adjusted.

The bar 56 is also provided with means, indicated 78, by which the scope mounting rings 26 can be affixed to the bar 56. In the depicted base embodiment 28, such means 78 include the internally-threaded holes 44, introduced earlier, opening out of the upper surface of the bar 56. To operatively mount the scope 24 upon the rifle 22 with the mount base 28 and rings 26 and with reference again to FIG. 2, the screws 70 are tightened within the rifle openings 31 and 33 so that the mount base 28 is securely attached to the barrel 30. The mounting rings 26 are thereafter secured to the base 28 by means of the screws 46 and holes 44 so that one ring 26 is disposed forwardly of the other ring 26. The scope 24 is then mounted within the rings 26 by positioning the scope body 38 within the arcuate portion 48 of the ring securement portion 42 and attaching the arcuate portion 50 to the arcuate portion 48 and across the scope body 38 with the screws 52.

As mentioned earlier, the mount base 28 is advantageous in that in enables a purchaser of the rifle 22 to mount a scope 24 upon the rifle 22 with the use of the factory-formed openings 31, 33 provided in the rifle. Therefore, the mount base 28 circumvents any need that a purchaser drill additional mounting holes in the rifle barrel 30 which could weaken the barrel 30 and increase the likelihood of barrel blow-up.

Figure 7:
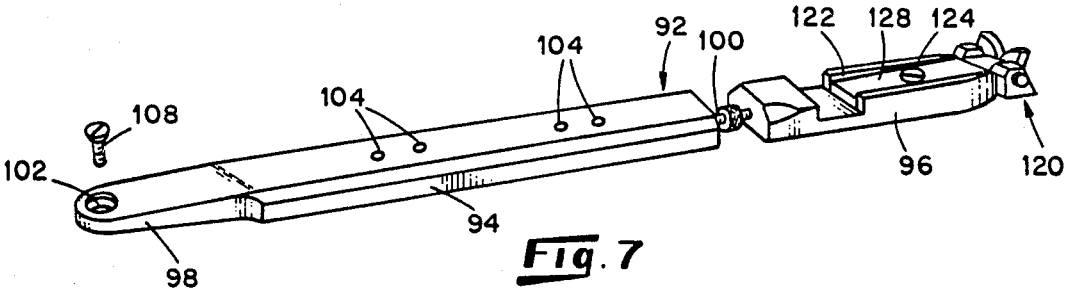
FIG. 7 is perspective view of an alternative embodiment of a scope mount base.
Figure 8:
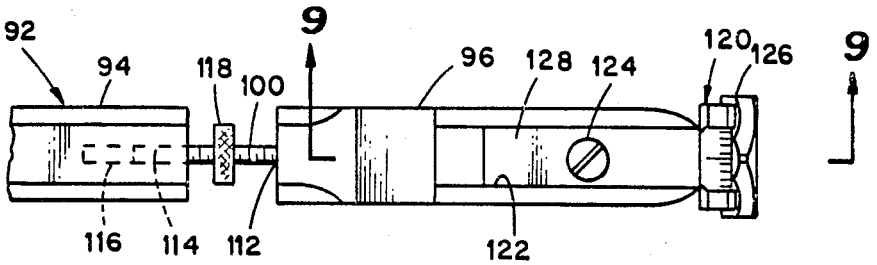
FIG. 8 is a fragmentary plan view of the FIG. 7 embodiment as seen generally from above in FIG. 7.
Figure 9:
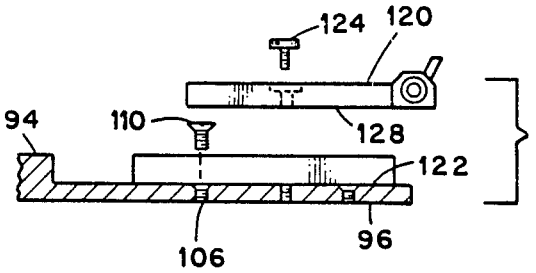
FIG. 9 is a cross-sectional view taken on lines 9—9 of FIG. 8, shown exploded.

With reference to FIG. 7–9, there is shown an alternative embodiment 92 of a mounting base. The base 92 includes bar means 94 including a forward bar section 96 and a rearward section 98 joined to one another by means of a threaded rod 100. The rearward section 98 is provided with an aperture 102 adjacent the rear end thereof which is adapted to receive a screw 108 (FIG. 7) for securement of the rearward section 98 to the rifle opening 31 (FIG. 1) used for attaching the rifle tang 36 to the stock 32. In addition, the rearward section 98 includes a set of internally-threaded holes 104 with which scope mounting rings 26 (FIGS. 1–3) can be secured to the bar means 94. As best shown in FIG. 9, the forward section 96 is provided with an aperture 106 adjacent the forward end thereof which is adapted to receive a screw 110 for securement of the forward section 96 to the rifle opening 33 normally used for holding the manufacturer-provided rear sight to the barrel 30. Hence, by inserting the screws 108, 110 through the section apertures 106, 102 and tightening the screws 108, 110 within the rifle openings 33, 31, the base 98 is operatively secured to the rifle 22.

The threaded rod 100 of the base 28 provides means by which the spacing between the base apertures 102, 106 can be adjusted to accommodate rifles whose openings corresponding to the pre-tapped openings 31 and 33 of the FIG. 1 rifle 22 are spaced at alternative distances. To this end and as best shown in FIG. 9, the threaded rod 100 is arranged generally along the longitudinal axis of the bar means 94 and includes two opposite ends 112, 114. One rod end 112 is secured within an end of the forward section 96 opposite the free end of the section 96, and the other rod end 114 is threadably received by an internally-threaded opening 116 defined in the end of the rearward section 98 opposite the free end of the section 98. By rotating the threaded rod 100 relative to the rearward section 98, the rearward and forward sections 98, 96 move toward and away from one another to thereby alter the distance at which the apertures 102, 106 are spaced. Therefore, the base 92 is adapted to be mounted upon a rifle having pre-tapped openings which are spaced apart by any distance within a range of spacing distances. To facilitate the rotation of the rod 100 relative to the rearward section 98, a knurled knob 118 is fixed about the rod 100.

For providing a replacement or substitute sight for the manufacturer-provided rear sight that is removed from the rifle when mounting the base 92 thereupon, the base 92 includes an adjustable sight 120 associated with its forward section 96. In this connection, the forward section 96 includes a channel 122 extending along its upper surface, and the sight 120 includes a shank 128 which is appropriately secured within the channel 122. The sight 120 is conventional in construction and includes adjustment screws 124 and 126 facilitating elevation and windage adjustments of the sight 120. More specifically, one screw 124 extends through the sight shank 128 for acting against the bottom of the channel 122 and thereby raising and lowering the V of the sight as the screw 124 is tightened or loosened, and the other screw 126 extends transversely of the sight shank 128 for moving the V of the sight 120 laterally with respect to the forward section 96 as the screw 126 is tightened or loosened. As best shown in FIG. 9, the forward section aperture 106 is located beneath the sight 120 so that the forward section 96 must be mounted upon the rifle prior to the securement of the sight 120 within the channel 122.

Figure 10:
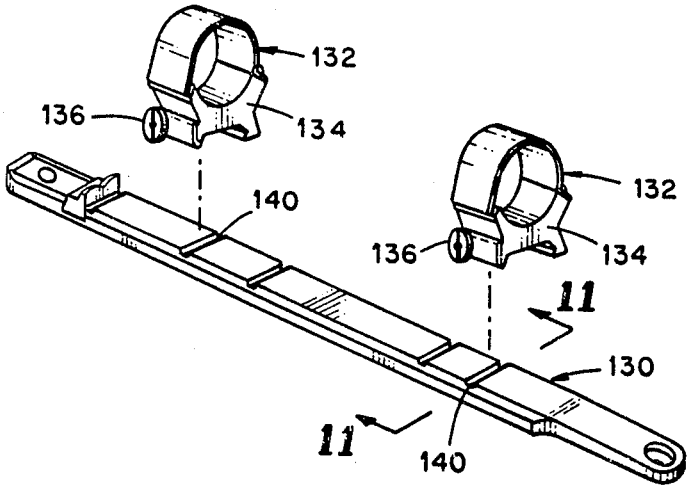
FIG. 10 is an exploded perspective view of a further embodiment of a scope mount base and scope mounting rings for use with the base.
Figure 11:
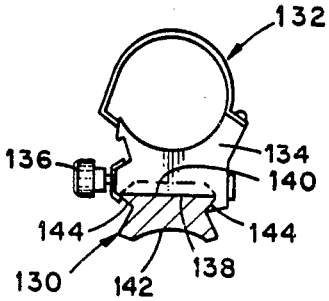
FIG. 11 is a cross-sectional view taken on line 11—11 of FIG. 10.

It will be understood that numerous and modifications can be had to the aforedescribed embodiments without departing from the spirit of the invention. For example, although the aforedescribed embodiments of FIGS. 1–9 have been shown and described as being used in connection with scope mounting rings 26 through which the iron sights of the rifle can be viewed, a mounting base may be used in connection with alternative types of scope mounting rings. For example, there is shown in FIGS. 10 and 11 a mounting base 130 for use in connection with scope mounting rings 132 each having a bottom piece 134 which obstructs the line of sight along which the iron sights are normally viewed. In the depicted ring 132, the bottom piece 134 is shaped to cooperate with guide tracks 144 appropriately formed along the body of the base 130 as best shown in FIG. 11 and is securable in position upon the base 130 by means of a screw 136 which extends through the bottom piece 134 for tightly securing the piece 134 about the sides of the base 130. Moreover, the upper surface of the base 130 includes transversely-extending grooves 140 for receiving a downwardly-projecting tab 138 provided in each ring bottom piece 134. When the tab 138 is operatively received by a groove 140, the ring 132 is prevented from shifting longitudinally of the base 130. A mounting ring 132 of the aforedescribed type is commercially available from W. R. Weaver Co., Lewiston, Id., and the base 130 is shaped to accommodate the attachment of the ring 132 thereto.

In addition, although the aforedescribed embodiments of FIGS. 1–9 have been shown and described for mounting upon a black powder rifle having a hexagonally-shaped barrel, a mounting base may be mounted upon a black powder rifle having a round barrel. For example, the base 130 of FIGS. 10 and 11 has an underside defining an arcuate downwardly-facing surface 142 for overlying a round rifle barrel. Accordingly, the aforedescribed embodiments are intended for the purpose of illustration and not as limitation.

What is claimed is:

1. A scope mount base for a black powder rifle having a pair of factory-formed, pre-tapped openings along its length, one of the pre-tapped openings adapted to receive a screw for holding a rear sight against the rifle barrel and the other of the pre-tapped openings adapted to receive a screw for joining the rifle breech to the rifle stock, said mount base comprising:

bar means including a forward portion for attachment to the rifle barrel by means of a screw threadably received by said one pre-tapped opening and a rearward portion for attachment to the breech by means of a screw threadably received by said other pre-tapped opening; and said forward and rearward portions joined to one another and providing means by which a scope can be secured to said bar means for mounting the scope upon the rifle.

2. The base as defined in claim 1 wherein each of the forward and rearward portions include an aperture for alignment with a corresponding one of said pre-tapped openings and for receiving the shank of a screw operatively received by the corresponding opening so that the forward and rearward portions can be held against the rifle by the heads of the screws.

3. The base as defined in claim 2 wherein said bar means includes a single bar providing both said forward and rearward portions.

4. The base as defined in claim 2 wherein said bar means includes two elongate bar sections arranged in an end-to-end arrangement and means for joining the bar sections in the end-to-end arrangement, one of said bar sections providing the forward portion of said bar means the other of the bar sections providing the rearward portion of said bar means.

5. The base as defined in claim 4 wherein said joining means is adapted to permit said bar sections to be moved toward and away from one another so that each screw-receiving aperture of said forward and rearward portions can be aligned with corresponding pre-tapped opening in the rifle and wherein said pre-tapped openings are spaced apart by any distance within a range of spacing distances.

6. The base as defined in claim 5 wherein said joining means includes a threaded rod fixed within an end of one of said bar sections and threadably received by an internally-threaded hole formed in the end of the other of said bar sections so that rotation of one of said bar sections relative to the other of said bar sections moves said bar sections toward and away from one another.

7. The base as defined in claim 1 wherein a sight is associated with the forward portion of said bar means so that when said base is operatively mounted upon the rifle, said sight provides a rear iron sight for the rifle.

8. In combination, a scope mount base and scope mounting means for attachment of a scope upon a black powder rifle having a pair of factory-formed, pre-tapped openings along the top of the rifle, one of the pre-tapped openings adapted to receive a screw for holding a rear sight against the rifle barrel and the other of the pre-tapped openings adapted to receive a screw for joining the rifle breech to the rifle stock;

said scope mount base including bar means having a forward portion and a rearward portion, said forward portion including an aperture alignable with said one pre-tapped opening in the rifle for securement thereto with a screw and said rearward portion including an aperture alignable with said other pre-tapped opening in the rifle for securement thereto with a screw so that when said forward and rearward portions are operatively secured to said pre-tapped openings, said base is securely mounted upon the rifle; and said scope mounting means including an attachment portion cooperable with said bar means for securement of said mounting means to said base and including means for holding said scope in a fixed relationship to said attachment portion so that when said holding means operatively holds said scope as aforesaid and said attachment portion is operatively secured to said base, the scope is held in a fixed relationship to said base.

9. The combination of claim 8 wherein said bar means includes two elongated bar sections arranged in an end-to-end arrangement and means for joining the bar sections in the end-to-end arrangement, one of said bar sections providing the forward portion of said bar means and the other of the bar sections providing the rearward portion of said bar means, and said joining means is adapted to permit said bar sections to be moved toward and away from one another so that each of said apertures can be aligned with a corresponding pre-tapped opening in the rifle and wherein said pre-tapped openings are spaced apart by any distance within a range of spacing distances.

10. The combination of claim 8 wherein said base includes a sight associated with said forward portion for providing a rear iron sight for the rifle, and said attachment portion of said mounting means is shaped to permit a rifle upon which the base and mounting means are mounted to be sighted along the iron sights of the rifle.

11. The combination of claim 10 wherein said attachment portion includes an opening encircling the line along which the rifle is sighted with its iron sights so that when a scope is operatively mounted upon the rifle by means of the base and scope mounting means, the rifle can be selectively sighted through its iron sights or through the scope.

12. A black powder rifle assembly comprising:

a black powder rifle having a pair of factory-formed, pre-tapped openings along its length, one of the pre-tapped openings adapted to receive a screw for holding a rear sight against the rifle barrel and the other of the pre-tapped openings adapted to receive a screw for joining the rifle breech to the rifle stock;

a mount base including bar means having a forward portion attached to the rifle barrel by means of a screw threadably received by said one pre-tapped opening and a rearward portion attached to the rifle breech by means of a screw threadably received by said other pre-tapped opening;

a scope; and scope mounting means secured to said scope and attached in a stationary relationship upon said base so that said scope is operatively mounted upon said rifle.

13. The assembly as defined in claim 12 wherein said base includes a sight associated with said forward portion for providing a rear iron sight for the rifle, and said scope mounting means includes a support for maintaining a spacing between the scope and the bar means and which is shaped to permit the rifle to be sighted along its iron sights so that the rifle can be selectively sighted through its iron sights or through the scope.

* * * * *